US008716588B2

(12) United States Patent
Yoshida

(10) Patent No.: US 8,716,588 B2
(45) Date of Patent: May 6, 2014

(54) KEY PRESS SWITCH FOR ELECTRONIC PIANO

(71) Applicant: Kabushiki Kaisha Kawai Gakki Seisakusho, Hamamatsu (JP)

(72) Inventor: Koji Yoshida, Hamamatsu (JP)

(73) Assignee: Kabushiki Kaisha Kawai Gakki Seisakusho (JP)

( * ) Notice: Subject to any disclaimer, the term of this patent is extended or adjusted under 35 U.S.C. 154(b) by 0 days.

(21) Appl. No.: 13/905,193

(22) Filed: May 30, 2013

(65) Prior Publication Data

US 2013/0319210 A1 Dec. 5, 2013

(30) Foreign Application Priority Data

May 31, 2012 (JP) ..... 2012-124530

(51) Int. Cl.
*G10H 1/34* (2006.01)

(52) U.S. Cl.
USPC ..... 84/745

(58) Field of Classification Search
USPC ..... 84/745, 423 R, 720
See application file for complete search history.

(56) References Cited

U.S. PATENT DOCUMENTS 4,890,533 A * 1/1990 Katsuta et al. ..... 84/439
8,481,841 B2 * 7/2013 Shimoda ..... 84/744
2010/0282049 A1 11/2010 Yoshida
2011/0239846 A1 * 10/2011 Shimoda ..... 84/687
2013/0074684 A1 * 3/2013 Iwase et al. ..... 84/745

FOREIGN PATENT DOCUMENTS

| | | |
|---|---|---|
| JP | H04204797 | 7/1992 |
| JP | 2002162970 | 6/2002 |
| JP | 2002169562 | 6/2002 |
| JP | 3459844 | 10/2003 |
| JP | 3929835 | 6/2007 |
| JP | 2010026346 | 2/2010 |
| JP | 2010262129 | 11/2010 |

* cited by examiner

*Primary Examiner* — Jeffrey Donels

(74) *Attorney, Agent, or Firm* — Grossman Tucker Perreault & Pfleger PLLC

(57) ABSTRACT

A key press switch includes a main body portion configured to contact a pseudo hammer of the electronic piano and a contact portion provided in a part of the main body portion to contact the pseudo hammer. The contact portion includes a first contact portion and a second contact portion located closer to the fulcrum than the first contact portion. The contact portion is configured such that a contact position with the pseudo hammer is shifted from the first contact portion to the second contact portion in accordance with the key press amount of the electronic piano from the amount at which, in a standard acoustic piano, the damper load starts to be applied until the amount at which, in a standard acoustic piano, the damper load has been fully applied.

4 Claims, 6 Drawing Sheets

KEY PRESS SWITCH FOR ELECTRONIC PIANO

CROSS-REFERENCE TO RELATED APPLICATIONS

This application claims the benefit of Japanese Patent Application No. 2012-124530, filed May 31, 2012, in the Japan Patent Office, the entirety of which is incorporated herein by reference.

BACKGROUND

The present invention relates to a key press switch for an electronic piano to detect a key press motion.

It is well known that when a key press occurs in an acoustic piano, static touch characteristics (in the case of a grand piano) as shown in FIG. 5 are obtained in connection with a load applied to the pressed key by an operation of an action caused by the key press.

An electronic piano without an action mechanism as in an acoustic piano is provided with a pseudo action mechanism to thereby achieve, when a key press occurs, static touch characteristics similar to those to be obtained by an acoustic piano.

For example, the electronic piano is provided with a let-off member 6, as shown in FIG. 6, as a member constituting the pseudo action in order to obtain a let-off feeling that is included in the static touch characteristics of an acoustic piano.

In the electronic piano provided with the let-off member 6, a pseudo hammer 5 is raised when a key is pressed, and an engaging projection 27 attached to the pseudo hammer 5 contacts the let-off member 6 at a timing when a let-off should occur. Then, a let-off feeling will be provided (see Japanese Unexamined Patent Application Publication No. 2010-262129).

SUMMARY

The static touch characteristics of an acoustic piano also include variations in load as shown in FIG. 5 other than the let-off feeling. For example, the static touch characteristics in FIG. 5 show a phenomenon that a load becomes constant shortly after a key press, and subsequently increases and then becomes constant at such increased level before a let-off occurs.

The above is a load (hereinafter referred to as a "damper load") applied when a damper spoon secured at a rear end of a wippen pushes a damper lever to release a damper from a string in a case of an upright piano, or applied when a rear end of a key pushes up a damper lever to release a damper from a string in a case of a grand piano.

According to a conventional electronic piano, it is impossible to feel such damper load as a touch feeling. The conventional electronic piano is provided with a switch 100 to detect a motion of the pseudo hammer 5 as shown in FIG. 6, and occurrence/absence of a key press and strength of the key press are detected by the switch 100.

The switch 100 includes a switch main body 101 that pivots in an up-down direction at a non-player side of the switch main body 101 around a fulcrum at a player side of the switch main body 101. The switch 100 also includes a projection 102 in a part of the switch 100 to contact the pseudo hammer 5.

In such conventional electronic piano, a pseudo hammer 5 is raised when a key is pressed, and the switch main body 101 is pushed by the pseudo hammer 5 through the projection 102, so that occurrence/absence of a key press and strength of the key press are detected.

It is desirable that the present invention provide a key press switch for a pseudo action mechanism that allows a player to feel a damper load as a touch feeling by making an improvement in a part to contact a pseudo hammer.

A description will be provided below of a key press switch of the present invention.

The key press switch of the present invention includes: a main body portion configured to contact a pseudo hammer of the electronic piano at a non-player side of the main body portion and pivot around a fulcrum at a player side of the main body portion; and a contact portion provided in a part of the main body portion to contact the pseudo hammer. The contact portion includes a first contact portion and a second contact portion. The first contact portion is configured to contact the pseudo hammer before a key press amount of the electronic piano has reached an amount at which, in a standard acoustic piano, a damper load starts to be applied. The second contact portion is located closer to the fulcrum than the first contact portion and is configured to contact the pseudo hammer after the key press amount of the electronic piano has reached an amount at which, in a standard acoustic piano, the damper load has been fully applied. Both the first contact portion and the second contact portion are configured to contact the pseudo hammer while the key press amount of the electronic piano is from the amount at which, in a standard acoustic piano, the damper load starts to be applied until the amount at which, in a standard acoustic piano, the damper load has been fully applied. The contact portion is configured such that a contact position with the pseudo hammer is shifted from the first contact portion to the second contact portion in accordance with the key press amount of the electronic piano from the amount at which, in a standard acoustic piano, the damper load starts to be applied until the amount at which, in a standard acoustic piano, the damper load has been fully applied.

According to the configuration as above, the contact position between the pseudo hammer and the main body portion of the key press switch is shifted from the first contact portion to the second contact portion, which is located closer to the fulcrum of the main body portion than the first contact portion, in accordance with an increase of the damper load that increases, in a standard acoustic piano, with the key press amount.

When the contact position between the pseudo hammer and the main body portion is shifted to a position closer to the fulcrum of the main body portion, a load actually applied to the pseudo hammer increases correspondingly, and thus a player feels a greater force imposed on the key.

Further, since the load actually applied to the pseudo hammer starts to increase when the key press amount has reached an amount at which, in a standard acoustic piano, a damper load starts to be applied, the player feels as if a damper load is applied.

Accordingly, with an electronic piano constituted using the key press switch of the present invention, the player can play the electronic piano having a more similar feeling to playing an acoustic piano as compared with using a conventional electronic piano.

Also, in the electronic piano constituted using the key press switch of the present invention, the load actually increases during a key press, and thereby the key returns quickly when released. This enables an improved performance in terms of repeated pressing of the key.

If the load does not increase during a key press, even when the key is gently pressed, the key is fully pushed down only with a gentle press, and therefore it is difficult to determine what loudness is intended. Thus, it is difficult to produce a gentle sound. In contrast, in a case where the load increases during a key press as in the present invention, the key is not fully pushed down only with a gentle press, which facilitates production of a gentle sound.

The contact portion may have any configuration, such as a configuration having three or more protrusions. For a simplified configuration, the contact portion may include a first protrusion constituting the first contact portion and a second protrusion constituting the second contact portion.

Although the key press switch of the present invention may be configured such that when the key press switch pivots around the fulcrum, a first switch, a second switch, and a third switch are turned on in this order, two switches or more than three switches may be alternatively employed.

BRIEF DESCRIPTION OF THE DRAWINGS

The invention will now be described below, by way of example, with reference to the accompanying drawings, in which.

DETAILED DESCRIPTION OF THE PREFERRED EMBODIMENTS

Figure 1:
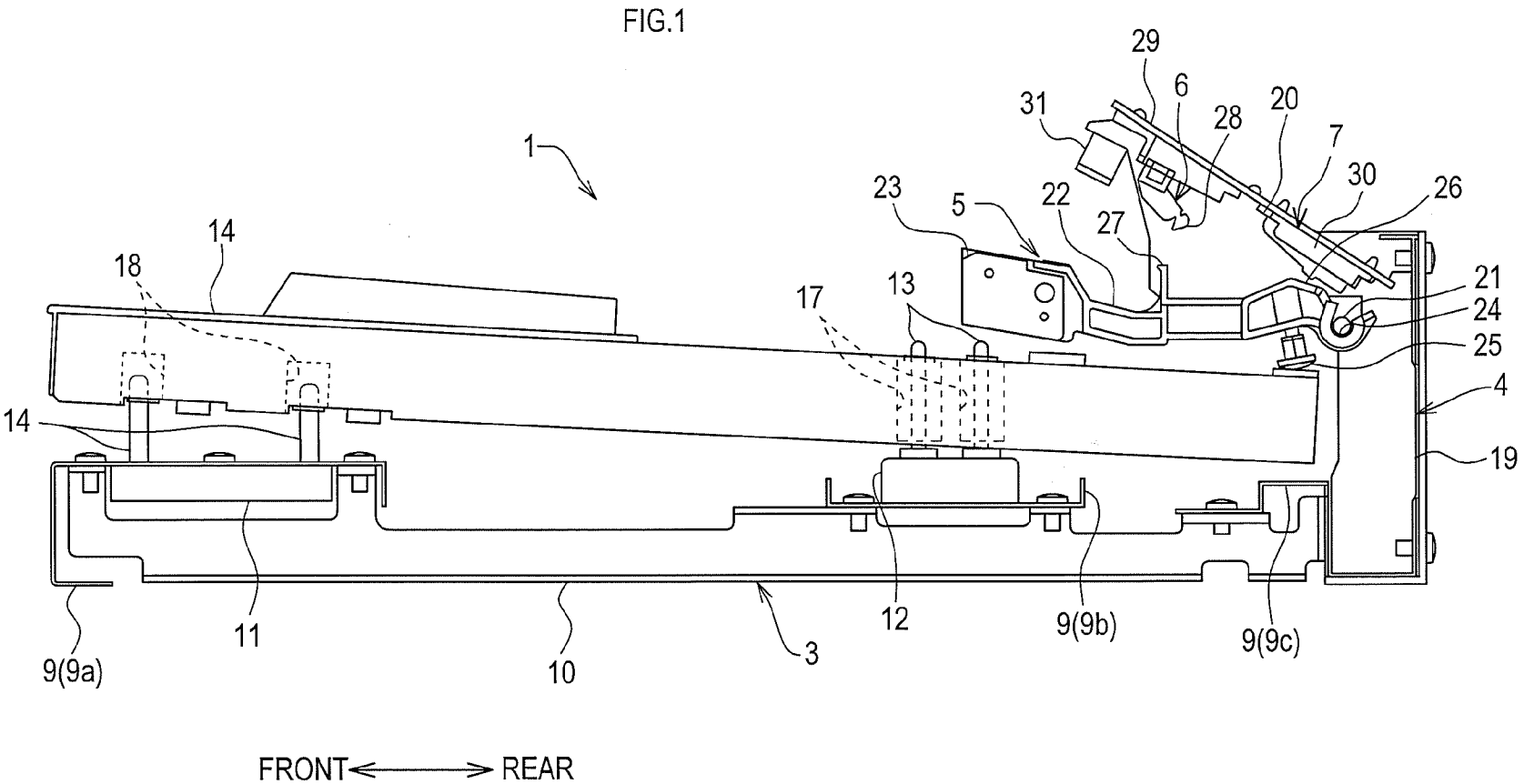
FIG. 1 is a side elevational view of one of eighty-eight key devices provided in an electronic piano according to one embodiment of the present invention.

As shown in FIG. 1, an electronic piano 1 includes a key 2, a keyboard chassis 3 to support the key 2, a hammer support 4 connected to a rear end portion (on a right side in FIG. 1) of the keyboard chassis 3, and a pseudo hammer 5 pivotable in conjunction with the key 2 when pressed.

The electronic piano 1 also includes a let-off member 6, a key press switch 7, etc. The let-off member 6 provides a let-off feeling when the key 2 is pressed. The key press switch 7 detects key press information about the key 2.

Although FIG. 1 shows a configuration of a single white key, the electronic piano 1 is provided with eighty-eight keys, including white keys and black keys arranged in a left-right direction as viewed from a player (a direction perpendicular to a paper plane of FIG. 1).

Next, a more detailed description will be provided of the electronic piano 1 with the aforementioned configuration. The keyboard chassis 3 is formed by assembling in parallel crosses three support rails 9, i.e., a front rail 9*a*, a center rail 9*b*, and a rear rail 9*c* each extending in the left-right direction; and five ribs 10 (FIG. 1 shows only one of the ribs 10) for reinforcement purpose each extending in a front-rear direction as shown in FIG. 1. The keyboard chassis 3 is secured on a not-shown key bed.

A keyframe front 11 is secured to a lower surface of the front rail 9*a*, and a keyframe center 12 is secured to an upper surface of the center rail 9*b*. The keyframe front 11 and the keyframe center 12 extend in the left-right direction (the direction perpendicular to the paper plane of FIG. 1) along the entire front rail 9*a* and the entire center rail 9*b*, respectively.

On the keyframe center 12, two balance pins 13 erected upward from an upper surface of the keyframe center 12 are arranged side by side along a longitudinal direction of the key 2. Also on the keyframe front 11, two front pins 14 erected upward from an upper surface of the keyframe front 11 are arranged side by side along the longitudinal direction of the key 2.

Balance pin holes 17 are formed at rearward of a longitudinal center of the key 2. By inserting the balance pins 13 into the balance pin holes 17, the key 2 is placed on the keyframe center 12 in a pivotable manner.

Front pin holes 18 are formed in a front end portion of the key 2. By inserting the front pins 14 into the front pin holes 18, the key 2 is suppressed from being fluctuated in the left-right direction during a pivoting motion thereof.

The hammer support 4 is constituted by interconnecting a plurality of molded articles each covering, for example, one octave. The hammer support 4 extends in the left-right direction over the entire pseudo hammers 5, and is screwed to the rear rail 9*c* of the keyboard chassis 3.

The hammer support 4 includes a hammer supporting portion 19 erected from near the rear rail 9*c* and a switch attachment portion 20 extending obliquely front-upward from an upper end portion of the hammer supporting portion 19.

In the upper end portion of the hammer supporting portion 19, there is provided a fulcrum shaft 21 having a horizontal pin-shape to support each of the pseudo hammers 5.

The pseudo hammer 5 includes an arm-like hammer body 22 extending in the front-rear direction, and a weight plate 23 attached to a front end portion of left and right sides faces of the hammer body 22.

The hammer body 22 is composed of a synthetic resin, while the weight plate 23 is composed of a metal material such as iron.

The hammer body 22 is provided, at a rear end portion thereof, with an arc-shaped shaft hole 24, and the pseudo hammer 5 is pivotably supported by the hammer support 4 through engagement of the shaft hole 24 with the fulcrum shaft 21.

A capstan screw 25 is screwed into a lower surface of the hammer body 22 at a location immediately forward of the shaft hole 24. The pseudo hammer 5 is placed on a rear end portion of the key 2 through the capstan screw 25.

Also, a portion of an upper surface of the hammer body 22 between the shaft hole 24 and the capstan screw 25 constitutes an actuator 26 to activate the key press switch 7 when the key 2 is pressed.

Further, in a central portion of the upper surface of the hammer body 22 in the front-rear direction, there is provided a plate-like engaging projection 27 to be brought into engagement with the let-off member 6 when the key 2 is pressed.

The let-off member 6 is constituted by a molded article of a predetermined elastic material (e.g., styrene thermoplastic elastomer), and is attached to the switch attachment portion 20 of the hammer support 4.

The let-off member 6 extends obliquely rear-downward from a front end portion of the switch attachment portion 20. A free end of the let-off member 6 includes a head portion 28 formed through a narrow part. The head portion 28 is positioned to face the engaging projection 27 of the pseudo hammer 5 while the key 2 is not pressed (i.e., in a non-key pressed state).

The key press switch 7 includes a switch body 30 constituted by a rubber switch. The switch body 30 is attached above the actuator 26 of the pseudo hammer 5.

The switch body 30 is positioned to face the actuator 26 of the pseudo hammer 5 with a gap therebetween while the key 2 is not pressed.

At a frontmost end portion of a lower surface of the switch attachment portion 20, there is provided a hammer stop 31 that is made of foaming urethane or the like to restrict upward pivoting motion of the pseudo hammer 5.

[Switch]

Next, a detailed description will be provided of members constituting the key press switch 7 according to the present invention.

Figure 2A:
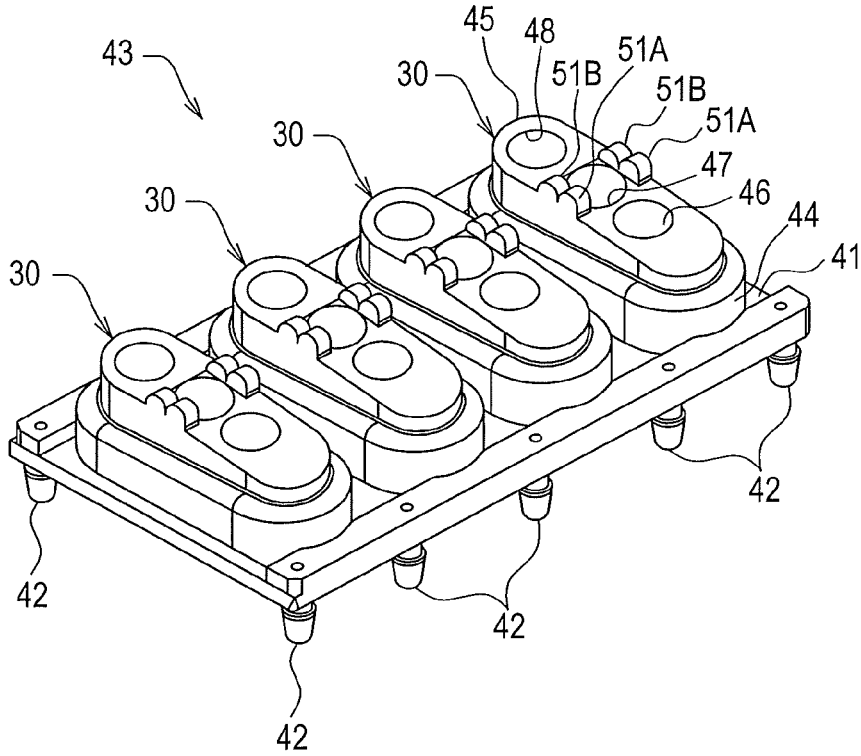
FIG. 2A is an upper perspective view of a key press switch.

The electronic piano 1 of the present embodiment includes a switch body unit 43 as shown in FIG. 2A. The switch body unit 43 is constituted by a base 41, four switch bodies 30 arranged mutually side by side on the base 41, and a plurality of legs 42 provided on a lower surface of the base 41, all of which are formed integrally.

Since the switch body unit 43 includes four switch bodies 30, each constituting the key press switch 7 of each key 2, the entire electronic piano 1 is provided with twenty-two switch body units 43 in total.

Figure 2B:
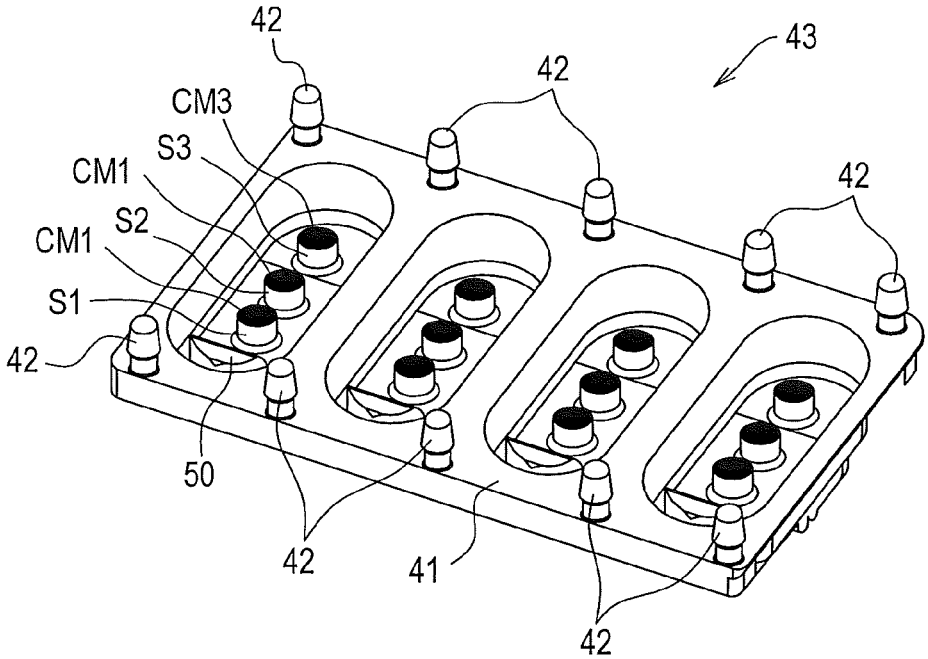
FIG. 2B is a lower perspective view of the key press switch.

Each of the switch bodies 30 constituting the switch body unit 43 includes a movable portion 45 (corresponding to an example of a main body portion in the present invention) and a peripheral wall portion 44. The movable portion 45 is configured to have a generally oval plane-like shape that is longitudinal in the front-rear direction. The peripheral wall portion 44 having a thin thickness is erected from the base 41 to support the movable portion 45 as shown in FIG. 2A. The switch body 30 as a whole is configured to have a dome shape as shown in FIG. 2B.

As shown in FIG. 2A, a surface of the movable portion 45 is configured to be tilted forward (rightward in FIG. 2A) relative to an upper surface of the base 41.

Figure 3:
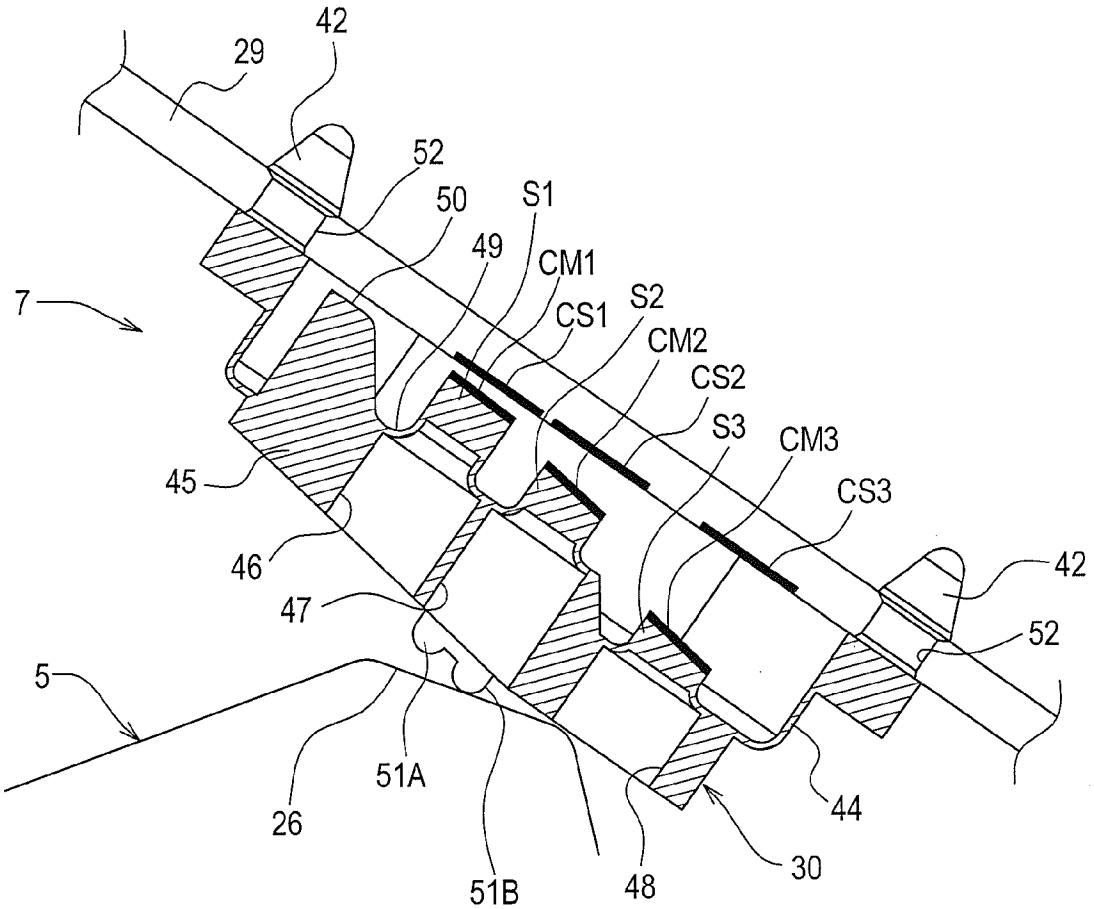
FIG. 3 is a cross-sectional view of a switch body of the key press switch shown in FIG. 1, taken along a cross section in an up-down direction, cutting the switch body at a center of a width direction extending in a left-right direction.

The movable portion 45 is provided with three cylindrical recesses 46 to 48 aligned in the front-rear direction. As shown in FIG. 3, first to third switch devices S1 to S3 are provided to be suspended from respective lower ends of the respective recesses 46 to 48 through a thin-thickness portion 49.

First to third movable contacts CM1 to CM3 made of, for example, carbon are provided on respective upper ends of the first to third switch device S1 to S3. The movable portion 45 also includes a support projection 50 located forward from the first switch device S1.

Further on the surface of the movable portion 45, there are provided two protrusions 51A and 51B aligned in the front-rear direction on each of left and right sides of the recess 47 that is centrally positioned. Each of these protrusions 51A and 51B has substantially a semicircular side shape and has a same size.

The switch body 30 configured as described above is attached to a lower surface of a switch substrate 29 by inserting the plurality of legs 42 into respective holes 52 provided in the switch substrate 29 as shown in FIG. 3.

While the key 2 is not pressed, the actuator 26 of the pseudo hammer 5 closely faces the protrusion 51B at rearward of the switch body 30. FIG. 3 shows a state immediately after the actuator 26 abuts the protrusion 51B following a key press.

Figure 4:
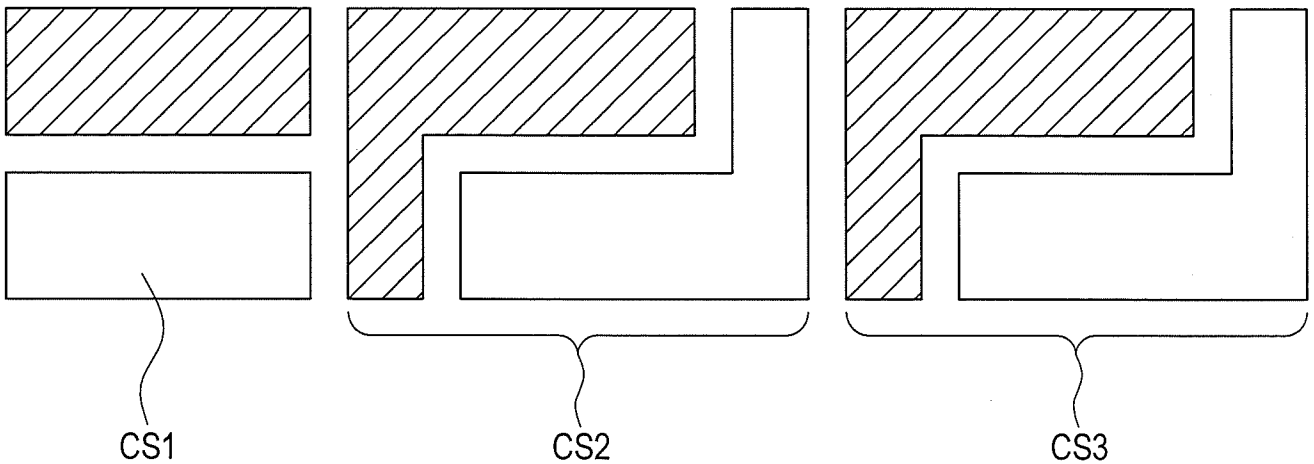
FIG. 4 is a plan view of the key press switch.
Figure 5:
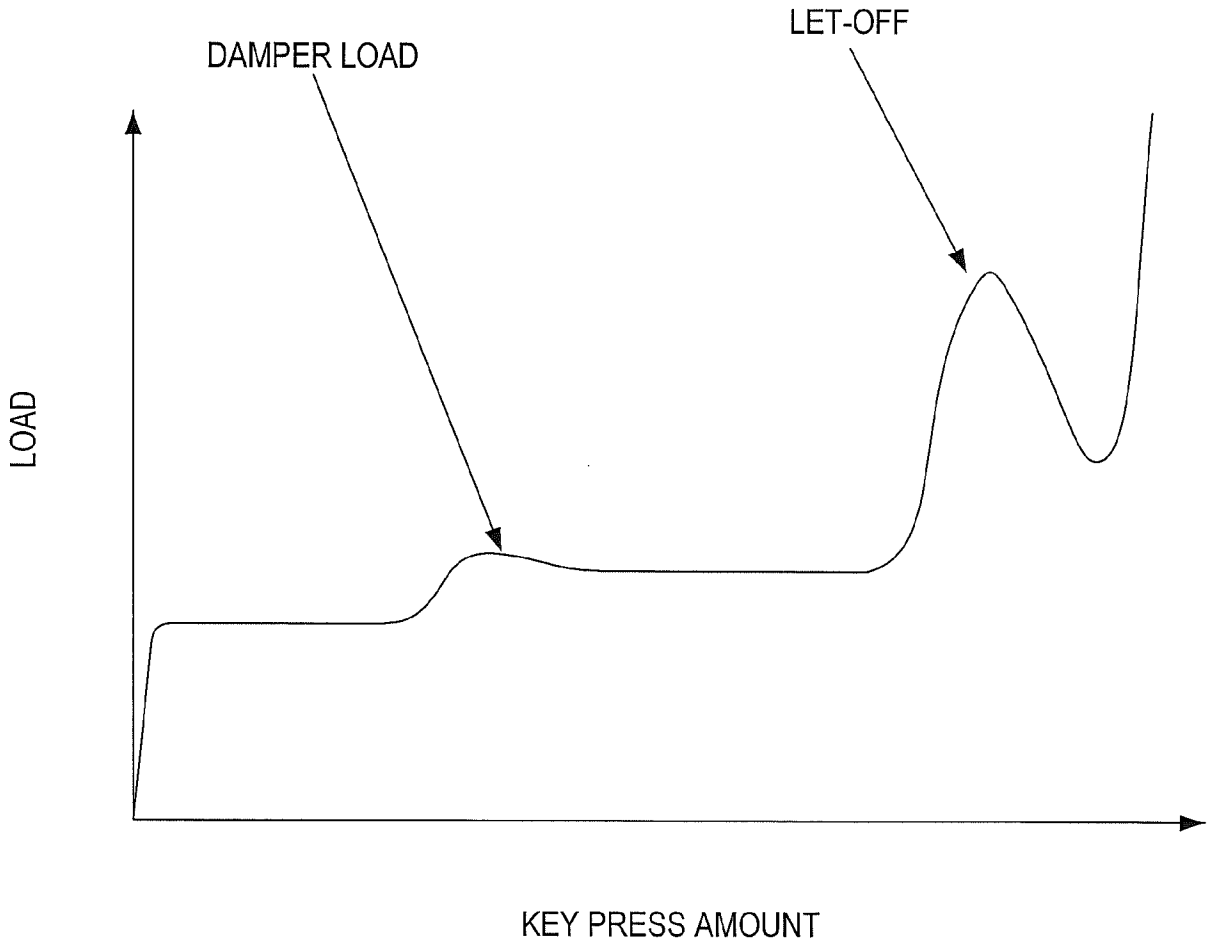
FIG. 5 is a graph showing static touch characteristics of an acoustic piano.
Figure 6:
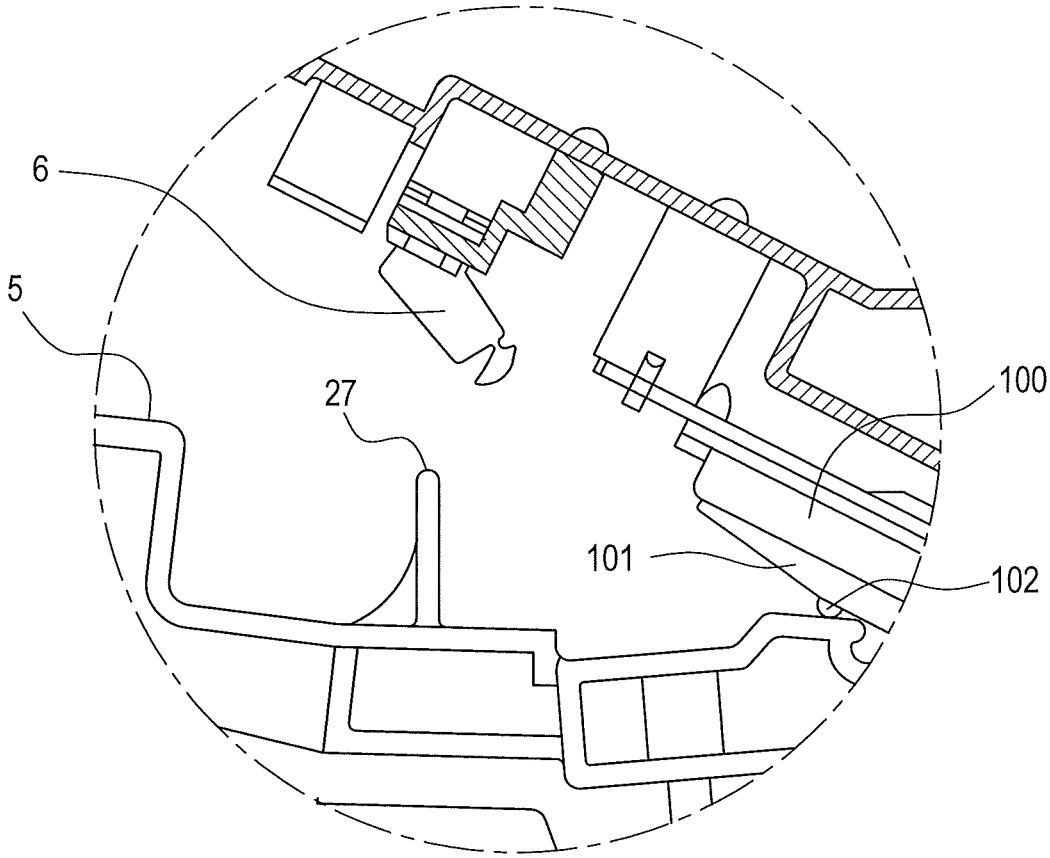
FIG. 6 is an enlarged view of an action provided in a conventional electronic piano, focusing on a configuration of a part in which a pseudo hammer strikes a let-off member.

While the key 2 is not pressed, the support projection 50 of the movable portion 45 closely faces the switch substrate 29, the first to third movable contacts CM1 to CM3 are arranged to face first to third stationary contacts CS1 to CS3, respectively, which are formed on the switch substrate 29 in each of the switch bodies 30 as shown in FIG. 4.

A distance between each facing set of the movable contact and the stationary contact becomes smaller in a forward direction, and the distance between the first movable contact CM1 and the first stationary contact CS1 is the smallest.

Each of the first to third stationary contacts CS1 to CS3 is constituted by two electrodes. When the two electrodes are connected by each of the first to third movable contacts CM1 to CM3, it is determined that the switch is turned on.

The key press switch 7 of the key 2 is constituted by the switch body 30 and the first to third stationary contacts CS1 to CS3.

[Key Press Operation]

Next, a description will be provided of an operation of the electronic piano 1 configured as above with reference mainly to FIG. 1 and also to FIGS. 2A, 2B, 3 and 4.

When the key 2 is pressed, the key 2 pivots around the keyframe center 12 as a fulcrum in a counterclockwise manner on the paper plane of FIG. 1. Then, the pseudo hammer 5 is pushed upward via the capstan screw 25 and starts to pivot around the fulcrum shaft 21 in a clockwise manner, and the actuator 26 contacts the protrusion 51B at rearward of the switch body 30, and the switch body 30 starts to be pushed.

Subsequently, the peripheral wall portion 44 is deformed, the support projection 50 contacts the switch substrate 29, and the movable portion 45 starts to pivot around the support projection 50 as a fulcrum.

When a key press amount is increased, and has reached an amount at which, in a standard acoustic piano, a damper load starts to be applied, the actuator 26 that has been in contact with only the protrusion 51B starts to also contact the protrusion 51A that is located closer to the support projection 50 than the protrusion 51B.

Then, a proportion of respective loads applied by the pseudo hammer 5 to the protrusion 51B and 51A, which are both in contact with the actuator 26, starts to be changed. When the key press amount is further increased, and has reached an amount at which, in a standard acoustic piano, the damper load has been fully applied, the movable portion 45 pivots from then onwards by being pushed by the pseudo hammer 5 only via the protrusion 51A.

Specifically, according to the electronic piano 1 of the present embodiment, a contact position of the movable portion 45 with the pseudo hammer 5 is shifted from the protrusion 51B to the protrusion 51A, which is located closer to the support projection 50 than the protrusion 51B, in accordance with the increase of the damper load that increases, in a standard acoustic piano, with the key press amount.

When the contact position of the movable portion 45 with the pseudo hammer 5 is shifted toward a position closer to the support projection 50 during a key press, the load applied on the pseudo hammer 5 is increased in association with the positional shift, and thereby the player will feel as if the damper load is applied.

Subsequently, soon after the movable portion 45 starts to be pushed through the protrusion 51A, the first movable contact CM1 contacts the first stationary contact CS1. When the movable portion 45 pivots further, the first switch device S1 is pushed into the recess 46, and the second movable contact CM2 contacts the second stationary contact CS2. When the movable portion 45 pivots still further, the second switch device S2 is pushed into the recess 47, and the third movable contact CM3 contacts the third stationary contact CS3. Such operation should be understood from FIG. 3.

When a timing for a let-off motion in the case of a standard acoustic piano has been reached after the movable portion 45 starts to be pushed by protrusion 51A, the engaging projection 27 is brought into engagement with the head portion 28 of the let-off member 6. When the pseudo hammer 5 pivots further, the engaging projection 27 presses the head portion 28 of the let-off member 6 in a compressing manner. When the pseudo hammer 5 pivots still further, the engaging projection 27 is disengaged from the head portion 28 of the let-off member 6.

Then, the player playing the electronic piano 1 of the present embodiment can obtain a let-off feeling similar to that of an acoustic piano due to increase and loss of reaction force received from the let-off member 6.

In the electronic piano 1 of the present embodiment, when the first to third switch devices S2 to S3 are turned on, a pivot speed of the pseudo hammer 5 is calculated based on differences in turn-on time among the first to third switch devices S2 to S3, and a sound corresponding to a note of the key 2 and with a certain loudness is produced based on a key number of the pressed key 2 and the calculation results.

Subsequently, the pseudo hammer 5 abuts the hammer stop 31, and thereby upward pivoting motion of the pseudo hammer 5 is terminated. When the key 2 is released, the key 2 pivots in a direction reverse to the direction when the key was pressed and returns to a non-key pressed state as shown in FIG. 1. As the result, the pseudo hammer 5 also pivots downward and returns to the non-key pressed state.

[Characteristic Advantages of Electronic Piano 1 of Present Embodiment]

In the present embodiment, the contact position between the pseudo hammer 5 and the movable portion 45 is shifted to a location closer to the fulcrum of the movable portion 45 during the pivoting motion of the pseudo hammer 5 to thereby increase the load applied to the pseudo hammer 5. Thus, it is possible to make the player feel as if a damper load is applied.

Accordingly, by using the electronic piano 1 of the present embodiment, the player can give a performance having a more similar feeling to playing an acoustic piano as compared with using a conventional electronic piano.

Also, in a case where the load is applied as described above, the key 2 returns quickly when released, which enables an improved performance in terms of repeated pressing of the electronic piano 1 of the present embodiment as compared with a conventional electronic piano.

If the load does not increase during a key press, even when the key is gently pressed, the key is fully pushed down only with a gentle press, and therefore it is difficult to determine what loudness is intended. Thus, it is difficult to produce a gentle sound. In contrast, according to the electronic piano 1 of the present embodiment, the load increases during a key press, and therefore the key is not fully pushed down only with a gentle press, which facilitates production of a gentle sound.

The present invention should not be limited to the embodiment described above, but can be implemented in various manners without departing from the scope of the invention set forth in the accompanying claims.

What is claimed is:

1. A key press switch for an electronic piano, comprising:

a main body portion configured to contact a pseudo hammer of the electronic piano at a rear side of the main body portion and pivot around a fulcrum at a front side of the main body portion; and a contact portion provided in a part of the main body portion to contact the pseudo hammer, the contact portion including a first contact portion and a second contact portion, the first contact portion being configured to contact the pseudo hammer before a key press amount of the electronic piano has reached an amount at which, in a standard acoustic piano, a damper load starts to be applied, the second contact portion being located closer to the fulcrum than the first contact portion and being configured to contact the pseudo hammer after the key press amount of the electronic piano has reached an amount at which, in a standard acoustic piano, the damper load has been fully applied, and both the first contact portion and the second contact portion being configured to contact the pseudo hammer while the key press amount of the electronic piano is from the amount at which, in a standard acoustic piano, the damper load starts to be applied until the amount at which, in a standard acoustic piano, the damper load has been fully applied, wherein the contact portion is configured such that a contact position with the pseudo hammer is shifted from the first contact portion to the second contact portion in accordance with the key press amount of the electronic piano from the amount at which, in a standard acoustic piano, the damper load starts to be applied until the amount at which, in a standard acoustic piano, the damper load has been fully applied.

2. The key press switch according to claim 1, wherein the contact portion includes:

a first protrusion constituting the first contact portion; and a second protrusion constituting the second contact portion.

3. The key press switch according to claim 1, wherein when the key press switch pivots around the fulcrum, a first switch, a second switch, and a third switch are turned on in this order.

4. The key press switch according to claim 2, wherein when the key press switch pivots around the fulcrum, a first switch, a second switch, and a third switch are turned on in this order.

* * * * *